US007448961B2

(12) United States Patent
Lin

(10) Patent No.: US 7,448,961 B2
(45) Date of Patent: Nov. 11, 2008

(54) GOLF CLUB HEAD HAVING A COMPLEX PLATE FORMED WITH AN UPRAISED PROTRUSION STRUCTURE

(75) Inventor: Chi-Ming Lin, Kaohsiung (TW)

(73) Assignees: Fu Sheng Industrial Co., Ltd., Taipei (TW); Nelson Precision Casting Co., Ltd., Kaohsiung (TW)

( * ) Notice: Subject to any disclaimer, the term of this patent is extended or adjusted under 35 U.S.C. 154(b) by 151 days.

(21) Appl. No.: 11/386,839

(22) Filed: Mar. 23, 2006

(65) Prior Publication Data

US 2007/0225086 A1 Sep. 27, 2007

(51) Int. Cl.
*A63B 53/04* (2006.01)

(52) U.S. Cl. ..... 473/332; 473/342; 473/346

(58) Field of Classification Search ..... None
See application file for complete search history.

(56) References Cited

U.S. PATENT DOCUMENTS 5,649,872 A * 7/1997 Antonious ..... 473/332
5,776,011 A 7/1998 Su et al.
5,967,903 A * 10/1999 Cheng ..... 473/342

FOREIGN PATENT DOCUMENTS

TW 550106 A 9/1992

* cited by examiner

*Primary Examiner*—Alvin A Hunter
(74) *Attorney, Agent, or Firm*—Muncy, Geissler, Olds & Lowe, PLLC

(57) ABSTRACT

A golf club head includes a golf club head body and a complex plate. The golf club head body includes an assembling opening to mount the complex plate. The complex plate includes a base plate and a protrusion structure which are made of different metal material. The upraised protrusion structure has a buffer structure formed therein. The complex plate has an outer (front) surface and an inner (rear) surface opposite to the outer surface. The protrusion structure is disposed on the inner surface of the complex plate. In assembling operation, the complex plate is received in the assembling opening of the golf club head body so as to constitute the golf club head.

17 Claims, 6 Drawing Sheets

GOLF CLUB HEAD HAVING A COMPLEX PLATE FORMED WITH AN UPRAISED PROTRUSION STRUCTURE

BACKGROUND OF THE INVENTION

1. Field of the Invention

The present invention relates to a golf club head having a complex plate formed with an upraised protrusion structure. More particularly, the present invention relates to the complex plate of the golf club head having a base plate and a plurality of upraised protrusions made of different metal material for providing high-degree characteristics of structural reinforcement and vibration absorbability.

2. Description of the Related Art

A conventional golf club head, as described in U.S. Pat. No. 5,776,011, entitled "Golf Club Head," typically includes a golf club head body and a striking plate mounted to a front opening of the golf club head body. Integrally formed on a rear surface of the striking plate is an upraised protrusion structure. The upraised protrusion structure is selectively constructed from a spiral-shaped upraised protrusion or a plurality of annular upraised protrusions. The upraised protrusion structure of the striking plate is so constructed to adjust the center of gravity for striking a golf ball. In the known art, such upraised protrusion structure and striking plate are constructed from a "one-piece" member and made from a single material. In this way, such an upraised protrusion structure of the striking plate cannot effectively absorb vibration of the golf club head in striking the golf ball if the striking plate is made from a high-degree elastically deformable material. On the other hand, such an upraised protrusion structure cannot provide a perfect high degree of elastic deformability in striking the golf ball if the striking plate is made from a high-degree vibration-absorbable material. In brief, such a striking plate of the conventional golf club head cannot possess a high degree of performance in both vibration absorbability and elastic deformability.

A conventional golf club head, as described in Taiwanese Patent Publication No. 550,106, entitled "joining method for a golf club head," discloses the following steps:

1. Preparing a first metal plate and a second metal plate made from a first metal and a second metal which are heterogeneous metals;

2. Joining the first metal plate and the second metal plate to form a complex metal plate, which has a shell shape, by explosion welding, and the first metal plate is disposed on a position corresponding to an outer surface of the golf club head and a center portion of the second metal plate is removed by a milling procedure;

3. Shaping the composite metal plate into a first part (i.e. striking plate) of the golf club head having a first peripheral configuration;

4. Preparing a second part (i.e. club head body) of the golf club head having a second peripheral configuration corresponding to the first peripheral configuration of the first part of the golf club head, and the second part made from a metal identical with the second metal of the complex metal plate;

5. Abutting the first peripheral configuration of the first part against the second peripheral configuration of the second part; and 6. Welding the second metal of the first part to the second metal of the second part to constitute the golf club head.

During striking the golf ball, a greater striking stress and a direct impact force are often exerted on a center portion (i.e. sweet spot area) of the first metal plate of the striking plate. Nevertheless, the center portion of the striking plate has a total thickness substantially identical with a thickness of the first metal plate due to the fact that the entire thickness of the center portion of the second metal plate has been removed. The first metal plate of the striking plate only has a periphery combined with the second metal plate after removed. Although it would be advantageous to make a thinner thickness of the center portion of the striking plate, the thinner thickness of the center portion of the striking plate is susceptible to the greater impact force during use. The center portion of the striking plate cannot therefore provide an adequate structural strength. Accordingly, it may cause easy distortion or cracks on the center portion of the striking plate after a long-term use.

Another problem with the thinner thickness of the center portion of the striking plate is unable to effectively absorb vibrations while striking the golf ball so that the useful life of the golf club head is relatively reduced. Hence, there is a need for improving the complex structure of the above-mentioned golf club head.

As is described in greater detail below, the present invention intends to provide a golf club head having a complex plate which consists of a first metal plate (layer), and a second metal plate (layer) on which being directly processed to form with an upraised protrusion structure. The upraised protrusion structure includes a plurality of annular protruded ribs and a reinforcing protruded block for providing high-degree characteristics of structural reinforcement and vibration absorbability. The first metal plate is made from a relatively light metal material so as to enhance striking stability and durability in such a way as to mitigate and overcome the above problem.

SUMMARY OF THE INVENTION

The primary objective of this invention is to provide a golf club head having a complex plate which consists of a first metal plate (layer), and a second metal plate (layer) on which being directly processed to form with an upraised protrusion structure. Accordingly, the protrusion structure can enhance structural strength, useful life and striking stability of the golf club head.

The secondary objective of this invention is to provide the golf club head having the complex plate provided with a reinforcing protruded block formed from the second metal plate. Accordingly, the reinforcing protruded block of the complex plate can enhance structural strength, useful life and striking stability of the golf club head.

Another objective of this invention is to provide the complex plate of the golf club head having a first metal plate made from a higher elastic deformable material, and a second metal plate made from a higher vibration absorbable material. Accordingly, the golf club head can possess high-degree elastic deformability and vibration absorbability.

The golf club head in accordance with an aspect of the present invention includes a golf club head body and a complex plate. The golf club head body includes an assembling opening to mount the complex plate. The complex plate includes a base plate and an upraised protrusion structure which are made of different metal material. The complex plate has an outer (front) surface and an inner (rear) surface opposite to the outer surface. The upraised protrusion structure is disposed on the inner surface of the complex plate. In assembling operation, the complex plate is received in the assembling opening of the golf club head body so as to constitute the golf club head.

In a separate aspect of the present invention, the upraised protrusion structure includes at least one reinforcing protruded block or a plurality of annular protruded ribs, or is in a meshed or honeycombed shape.

In a further separate aspect of the present invention, the base plate is made from a high-degree elastically deformable metal material.

In a yet further separate aspect of the present invention, the upraised protrusion structure is made from a high-degree vibration absorbable metal material.

In a yet further separate aspect of the present invention, the upraised protrusion structure has a buffer structure formed therein.

In a yet further separate aspect of the present invention, the buffer structure is constructed from a plurality of buffer grooves or recesses.

In a yet further separate aspect of the present invention, the buffer recess has a configuration selected from square, circular, triangular, rectangular and polygonal shapes or other geometric shapes.

In a yet further separate aspect of the present invention, the complex plate is applied to one or more of a striking plate, a crown plate, a skirt plate and a sole plate.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
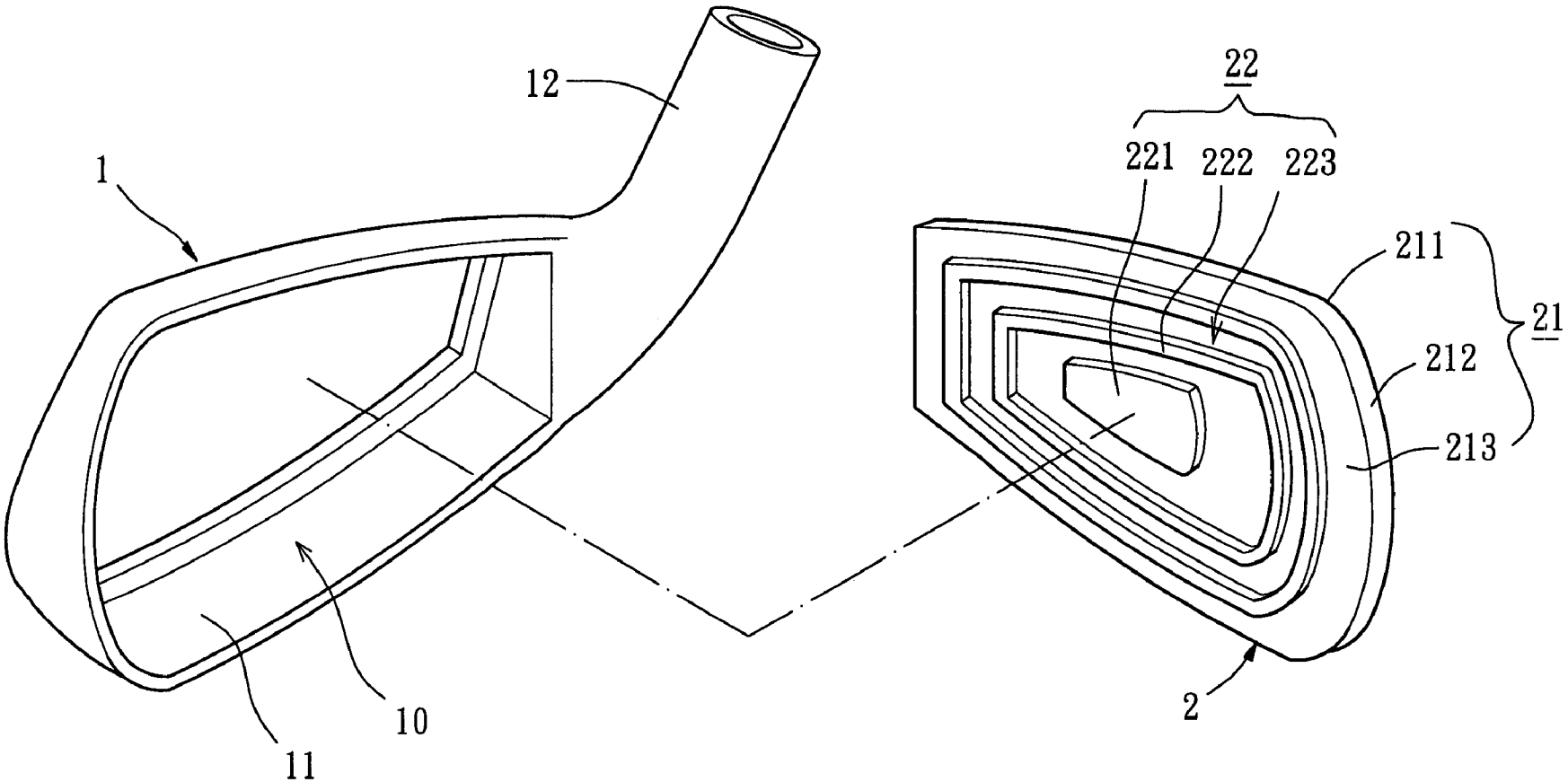
FIG. 1 is an exploded perspective view illustrating an iron-type golf club head body and a complex striking plate formed with an upraised protrusion structure in accordance with a first embodiment of the present invention.

In the following embodiments, a golf club head of the present invention can be selected from a group consisting of a wood-type club head, an iron-type club head, a utility-type club head and a putter-type club head. Referring initially to FIG. 1, an exploded perspective view of an iron-type golf club head body and a complex striking plate formed with an upraised protrusion structure in accordance with a first embodiment of the present invention is illustrated. The iron-type golf club head is exemplified in the first embodiment. The iron-type golf club head includes a golf club head body 1 and a complex striking plate 2 connected thereto. In a preferred embodiment, the complex striking plate 2 consists of a first metal plate (layer) 21 and a second metal plate (layer) 22 combined with each other, thus resulting in a "hybrid" one-piece design. In striking a golf ball (not shown), the first metal plate 21 is a main plate to structurally connect with the golf club head body 1, and is used to impact the golf ball. In a desired milling procedure, the second metal plate 22 is processed to provide various types of protrusion structures for reinforcing the entire structure of the first metal plate 21.

Figure 2:
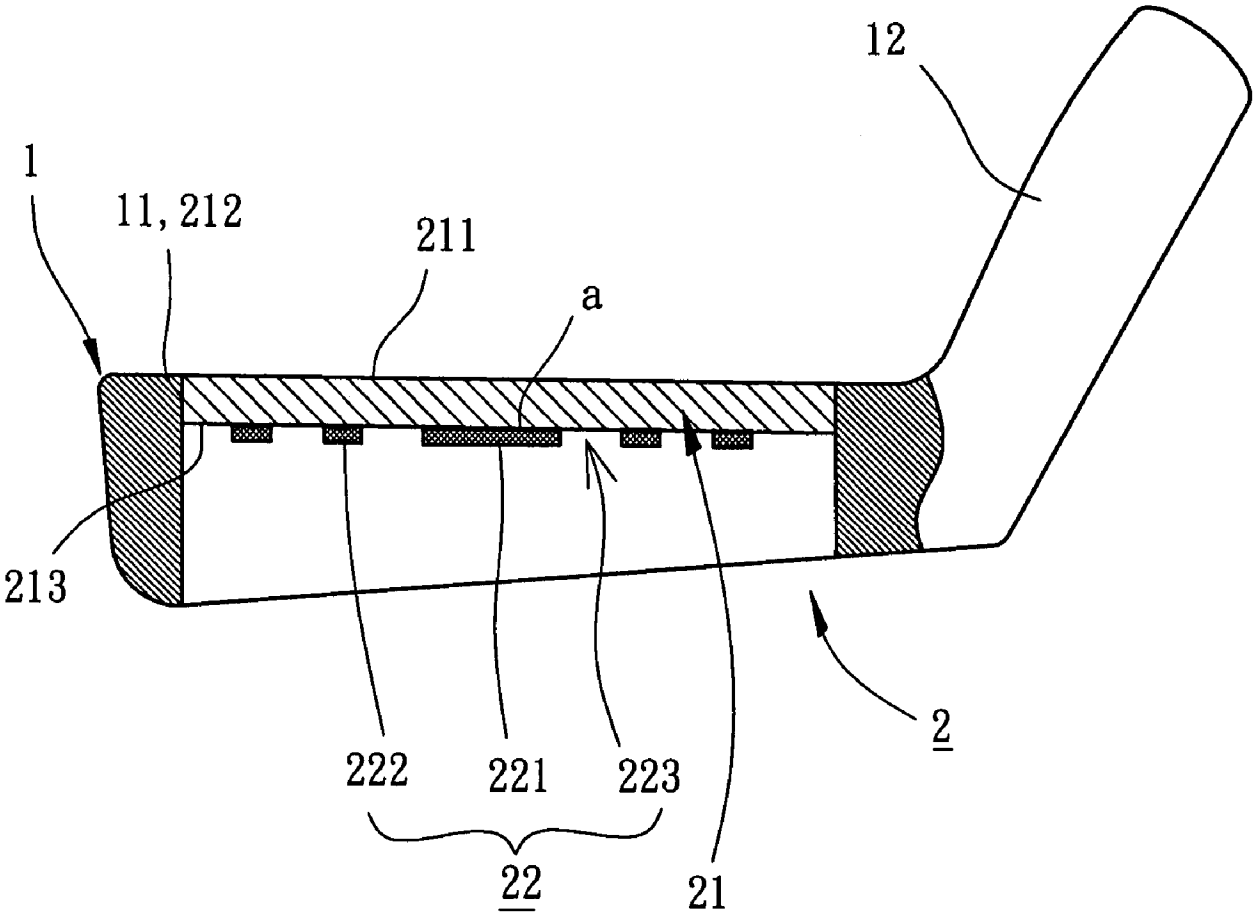
FIG. 2 is a partially cross-sectional view illustrating the iron-type golf club head having the complex striking plate formed with the upraised protrusion structure in accordance with the first embodiment of the present invention.

Turning now to FIG. 2, a partially cross-sectional view of the iron-type golf club head having the complex striking plate formed with the protrusion structure in accordance with the first embodiment of the present invention is illustrated. In a preferred embodiment, the golf club head body 1 is made from a material selected from a group consisting of metals of carbon steel, stainless steel (e.g. 17-4PH stainless steel), alloy steel, Fe—Mn—Al alloy, nickel-based ferroalloy, cast iron, super alloy steel, titanium alloy, copper alloy, aluminum alloy, magnesium alloy or mixtures thereof, or nonmetals of carbon fibers or mixtures thereof, or mixtures of foregoing metals and nonmetals. In the first embodiment, the entire structure of the golf club head body 1 is relatively rigid and strong to withstand normal usage of the striking stress, and is suitable for performing a high degree of the elastic deformation characteristic.

Constructions of the golf club head body 1 in the first embodiment shall be described in detail, by referring to FIGS. 1 and 2. The golf club head body 1 includes a blade portion, a sole portion, a heel-side portion and a toe-side portion which define a hollow ring body. The golf club head body 1 further includes an assembling opening 10, an engaging wall 11 and a neck portion (i.e. hosel) 12. The assembling opening 10 is disposed in a front portion of the golf club head body 1 such that a rear cavity is formed on a rear portion thereof. The engaging wall 11 is engaged with the complex striking plate 2, and is disposed on an inner wall which delimits the hollow portion in the assembling opening 10 of the golf club head body 1. Preferably, the neck portion 12 is integrally or separately formed or mounted on the heel-side portion of the golf club head body 1 to combine a club shaft (not shown).

Still referring to FIGS. 1 and 2, constructions of the first metal plate 21 of the complex striking plate 2 in the first embodiment shall be described in detail. The complex striking plate 2 generally has an outer (front) surface and an inner (rear) surface opposite to the outer surface. In the first embodiment, the first metal plate 21 of the complex striking plate 2 is preferably made from a high-degree elastically deformable metal material selected from a group consisting of stainless steel, carbon steel, Fe—Mn—Al alloy, aluminum alloy, magnesium alloy or titanium alloy. Generally, the first metal plate 21 has a front surface 211, an engaging outer circumference 212 and a rear surface 213 opposite to the front surface 211. The front surface 211 is used to directly strike the golf ball. The engaging outer circumference 212 is corresponding to the engaging wall 11 of the golf club head body 1 when the golf club head body 1 and the complex striking plate 2 are assembled. The rear surface 212 is securely mounted to the second metal plate 22 when the complex striking plate 2 is manufactured.

Still referring to FIGS. 1 and 2, constructions of the second metal plate 22 of the complex striking plate 2 in the first embodiment shall be described in detail. The second metal plate 22 of the complex striking plate 2 is made from a metal material different from that of the first metal plate 21 such that the metal materials of the first and second metal plates 21, 22 are made from heterogeneous metals. For instance, the metal material of the second metal plate 22 is made from a high-degree vibration absorbable metal material selected from a group consisting of carbon steel, stainless steel (e.g. 17-4PH stainless steel), alloy steel, nickel-based ferroalloy, cast iron, super alloy steel, titanium alloy, copper alloy, aluminum alloy, magnesium alloy and mixtures thereof. In this embodiment, the second metal plate 22 has a combing surface (unlabeled) to combine with the rear surface 213 of the first metal plate 21. In manufacturing, the first and second metal plates 21, 22 are preferably processed by explosion welding, rolling, adhesion, or a combination thereof such that the first and second metal plates 21, 22 are combined to constitute the complex striking plate 2. Formed between the first metal plate 21 and second metal plate 22 is an explosion-welding layer "a" or rolled connection layer after the first and second metal plates 21, 22 are preferably processed by explosion welding or rolling. In another preferred embodiment, sandwiched in-between the first metal plate 21 and second metal plate 22 is an adhesive layer after the first and second metal plates 21, 22 are preferably combined by adhesion.

Still referring to FIGS. 1 and 2, in practicing the complex striking plate 2, the second metal plate 22 is processed by milling, etching, grinding or a combination thereof to remove unwanted portions of the second metal plate 22 when the first metal plate 21 and the second metal plate 22 are completely combined. The second metal plate 22 is processed to form the protrusion structure constructed from high-degree vibration absorbable or heterogeneous protrusions, including a reinforcing protruded block 221 and a plurality of annular protruded ribs 222 with respect to the rear surface 213 of the first metal plate 21. Accordingly, the upraised protrusion structure of the second metal plate 22 increases the vibrational absorbability of the complex striking plate 2. There may be as many as annular protruded ribs 222. Formed between the two adjacent annular protruded ribs 222, and the reinforcing protruded block 221 and annular protruded rib 222 are buffer grooves 223 where a buffer structure is formed to provide adequate spaces for deformation of the complex striking plate 2 while striking the golf ball. Advantageously, the second metal plate 22 so constructed from such buffer grooves 223 accomplishes a wider range of elastic deformation of the entire complex striking plate 2 such that it permits the second metal plate 22 to be made from a low-degree elastically deformable metal material.

In the assembling opening 10, when the engaging outer circumference 212 of the complex striking plate 2 is engaged with the engaging wall 11 of the golf club head body 1, the front surface 211 of the complex striking plate 2 is in perfect alignment with a front outer surface of the golf club head body 1 with reference to FIG. 2. Preferably, the first metal plate 21 of the complex striking plate 2 is fixed to the golf club head body 1 by means of tungsten inert gas (TIG) welding, laser welding, electron beam welding, plasma welding or other suitable welding methods. In another embodiment, braze welding, adhesive, close fitting, screw connection or other equivalent connections or fasteners may be used. Once secured, the golf club head body 1 and the complex striking plate 2 are assembled to constitute the golf club head. In a preferred embodiment, the second metal plate 22 includes an engaging outer circumference to engage with the engaging wall 11 of the golf club head body 1.

Referring back to FIG. 1, the reinforcing protruded block 221 of the second metal plate 22 is preferably disposed on a sweet spot area of the complex striking plate 2 while the annular protruded ribs 222 are arranged to surround the reinforcing protruded block 221 in order. In a preferred embodiment, each of the annular protruded ribs 222 has a configuration substantially identical with that of the engaging wall 11 of the golf club head body 1. In another embodiment, the annular protruded rib 222 has a spiral form surrounding the reinforcing protruded block 221. In striking the golf ball, the reinforcing protruded block 221 and the annular protruded ribs 222 of the second metal plate 22 made from a different metal can disperse a striking stress exerting on the complex striking plate 2 such that the structural strength and the useful life of the complex striking plate 2 are increased. Furthermore, the buffer grooves 223 can accomplish a wider range of elastic deformation of the entire complex striking plate 2. As explained above, the first metal plate 21 is made from a high-degree elastically deformable metal material and the second metal plate 22 is made from a high-degree vibration absorbable metal material such that the complex striking plate 2 is designed to have a high degree of performance in both elastic deformability and vibration absorbability characteristics.

Figure 3:
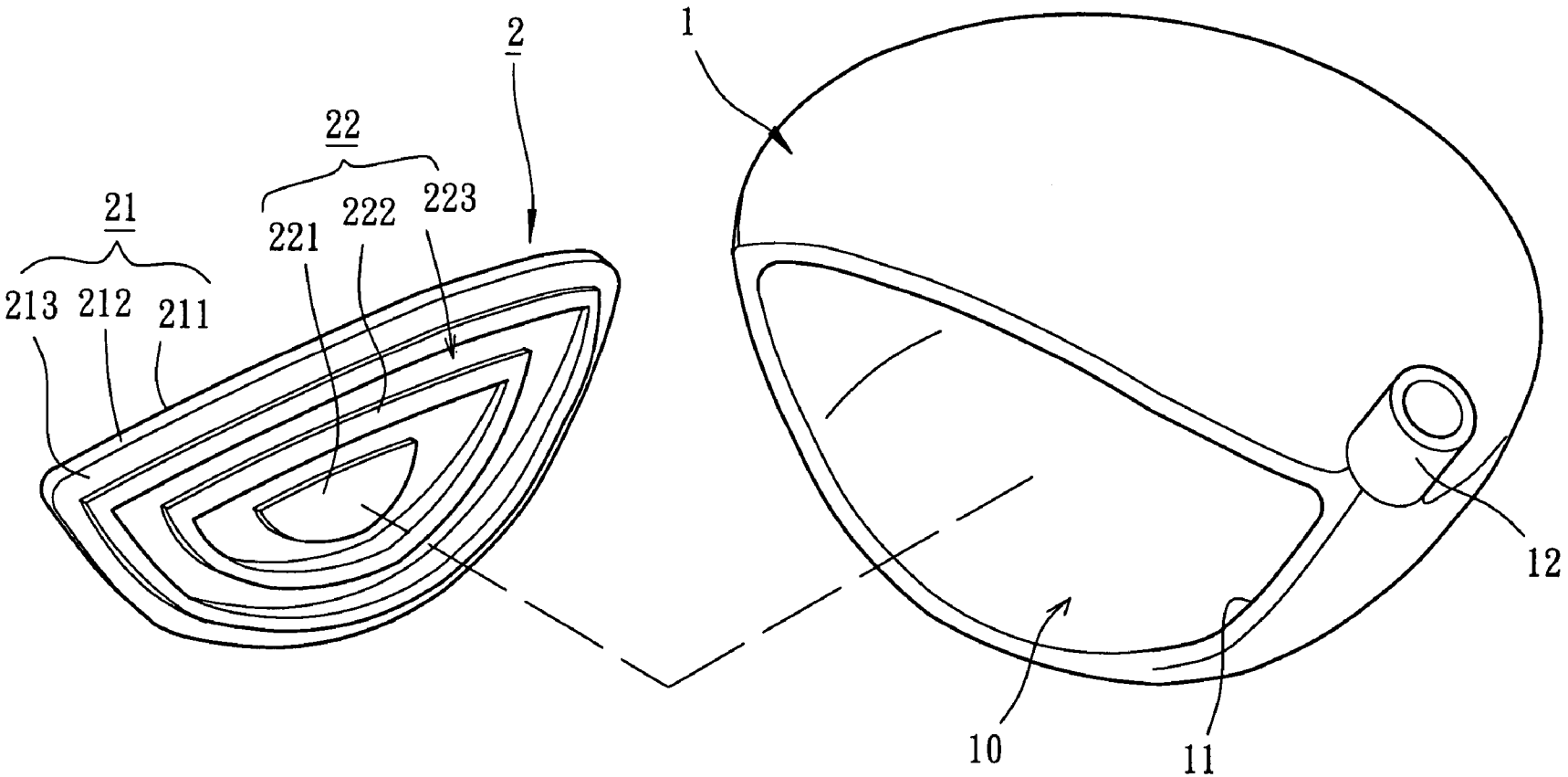
FIG. 3 is an exploded perspective view illustrating a wood-type golf club head body and a complex striking plate formed with the upraised protrusion structure in accordance with a second embodiment of the present invention.

Turning now to FIG. 3, an exploded perspective view of a wood-type golf club head body and a complex striking plate formed with the upraised protrusion structure in accordance with a second embodiment of the present invention is illustrated. In comparison with the first embodiment, the wood-type golf club head is exemplified in the second embodiment. The golf club head body 1 includes a striking portion, a crown portion, a sole portion, a rear skirt portion, a heel-side skirt portion and a toe-side skirt portion which define a hollow body. Each of the annular protruded ribs 222 has various vertical heights. A vertical height of the annular protruded rib 222 proximate a sole portion is greater than that proximate a crown portion such that a portion of the complex striking plate 2 adjacent to the sole plate has a greater degree of vibration absorbability characteristic relative to the other portion. The vertical height of the annular protruded rib 222 is gradually increased from the crown-side portion to the sole-side portion of the complex striking plate 2. In a preferred embodiment, the reinforcing protruded block 221 has a vertical height gradually increasing from the crown-side portion to the sole-side portion of the complex striking plate 2. It is apparent that the upraised protrusion structure lies in the interior of the golf club head when the golf club head body 1 and the complex striking plate 2 are assembled. This results in an increase of weight of the lower portion of the golf club head such that the center of gravity of the golf club head is lowered. Consequently, the striking stability of the golf club head is enhanced, and the center of gravity of the golf club head can be adjusted.

Figure 4:
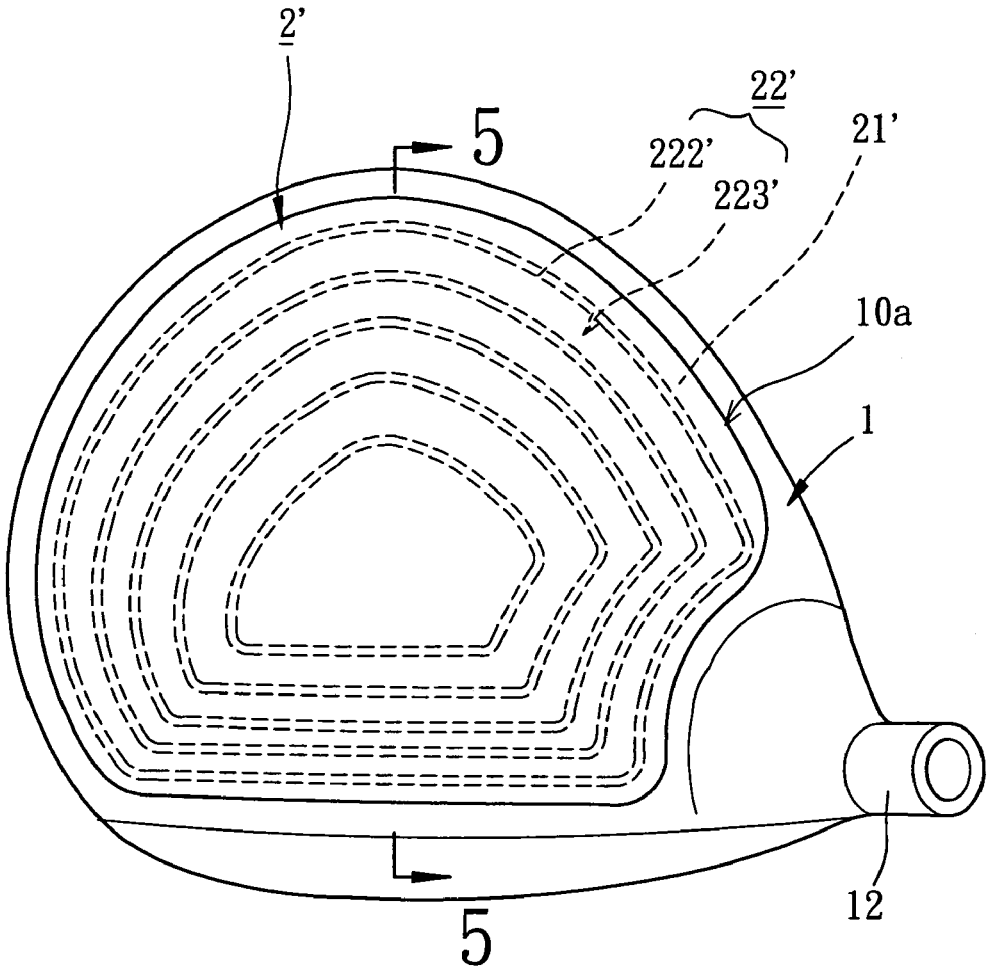
FIG. 4 is a top plan view illustrating the wood-type golf club head having a complex crown plate formed with the upraised protrusion structure in accordance with a third embodiment of the present invention.
Figure 5:
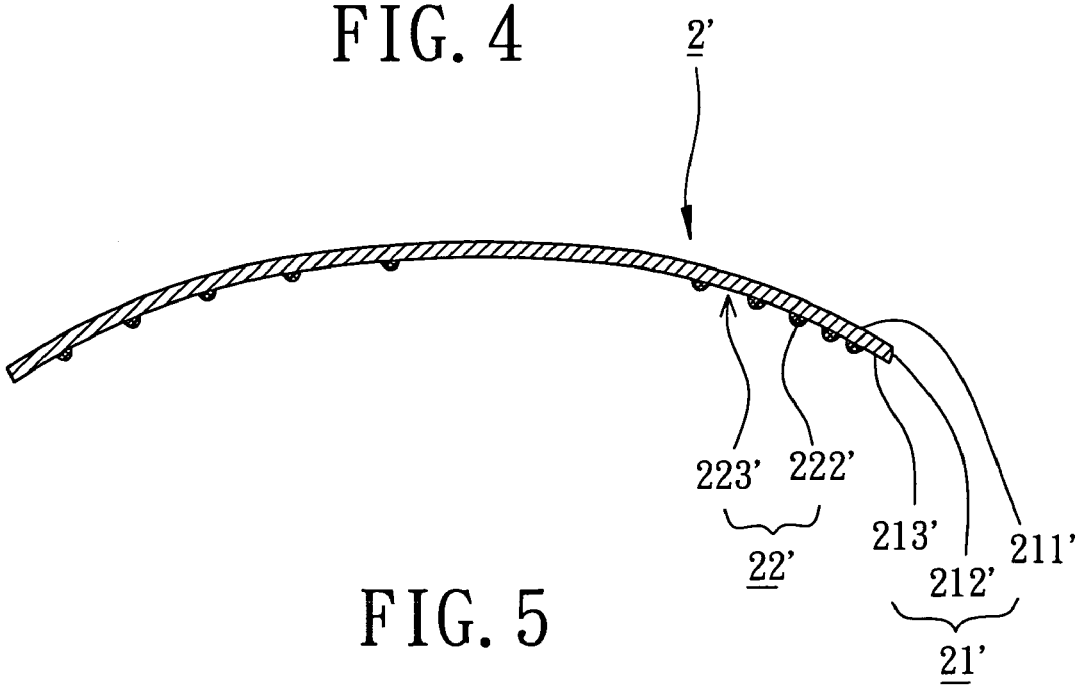
FIG. 5 is an isolated, cross-sectional view, taken along line 5-5 in FIG. 4, illustrating the complex crown plate of the wood-type golf club head having the upraised protrusion structure in accordance with the third embodiment of the present invention.

Turning now to FIG. 4, a top plan view of the wood-type golf club head having a complex crown plate formed with the upraised protrusion structure in accordance with a third embodiment of the present invention is illustrated. In comparison with the second embodiment, the wood-type golf club head of the third embodiment includes a complex crown plate 2' formed by combing a first metal plate 21' with a second metal plate 22'. After combining, the second metal plate 22' is processed to form an upraised protrusion structure, including a plurality of annular protruded ribs 222'. In a preferred embodiment, each of the annular protruded ribs 222' has a non-circular form of ring. Formed between the two adjacent annular protruded ribs 222' are buffer grooves 223' where adequate spaces for deformation of the complex crown plate 2' is provided for striking the golf ball. Preferably, the complex crown plate 2' is fixed to the assembling opening 10*a* of the golf club head body 1 by means of tungsten inert gas (TIG) welding, laser welding, electron beam welding, plasma welding or other suitable welding methods. In another embodiment, braze welding, adhesive, close fitting, screw connection or other equivalent connections or fasteners may be used. Other portions of the golf club head body 1 for utilization of the complex plate of the present invention are the sole, sidewall or rear wall instead of the crown. Once secured, the golf club head body 1 and the complex crown plate 2' are assembled to constitute the golf club head. Turning now to FIG. 5, an isolated, cross-sectional view, taken along line 5-5 in FIG. 4, of the complex crown plate of the wood-type golf club head is illustrated. The first metal plate 21' and the second metal plate 22' are made from different metal materials, however, the material of the first metal plate 21' has a specific gravity lower than that of the second metal plate 22' that can adjust a specific center of gravity of the complex crown plate 2'. In a preferred embodiment, one or each of the buffer grooves 223' may vary in width depending on the design of the golf club head. In a preferred embodiment, the width of the buffer grooves 223' adjacent to the front side (i.e. striking plate side) of the complex crown plate 2' is narrower than that adjacent to the rear side so as to specially reinforce the structure of the front side of the complex crown plate 2'. In an alternative embodiment, the width of the buffer grooves 223' adjacent to the front side (i.e. striking plate side) of the complex crown plate 2' is wider than that adjacent to the rear side.

Figure 6:
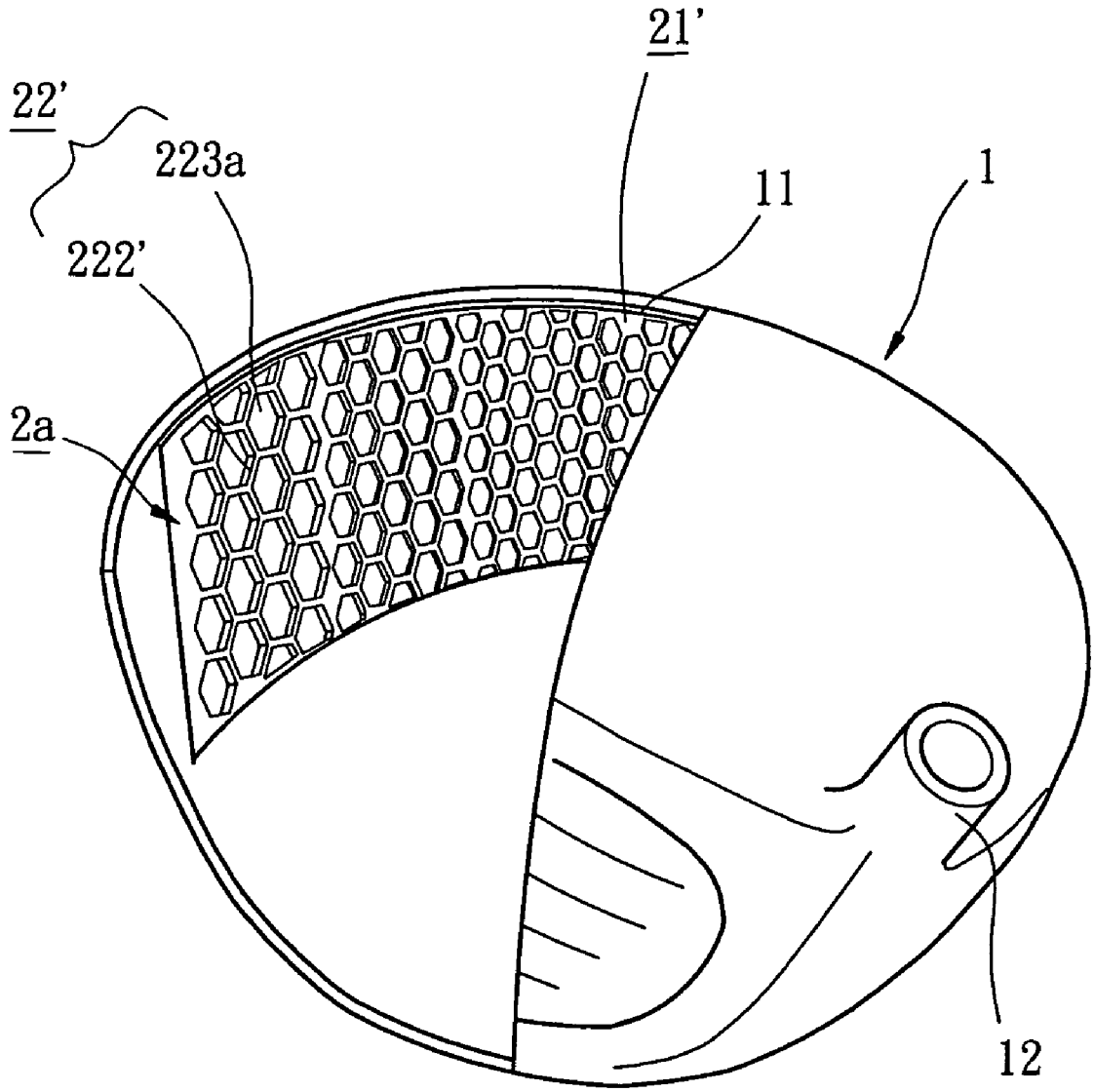
FIG. 6 is a partially cutaway, perspective view illustrating the wood-type golf club head having the complex skirt plate formed with the upraised protrusion structure in accordance with a fourth embodiment of the present invention.

Turning now to FIG. 6, a partially cutaway, perspective view of the wood-type golf club head having the complex skirt plate (sidewall) formed with the upraised protrusion structure in accordance with a fourth embodiment of the present invention is illustrated. In comparison with the third embodiment, the wood-type golf club head of the fourth embodiment includes a complex skirt plate 2*a* formed by combing a first metal plate 21' with a second metal plate 22'. The complex skirt plate 2*a* includes a heel-side skirt portion, a rear skirt portion and a toe-side skirt portion. After combining, the second metal plate 22' is processed to form an upraised protrusion structure, including a plurality of annular protruded ribs 222'. Formed among the annular protruded ribs 222' are buffer recess 223*a* where an adequate space for deformation of the complex skirt plate 2*a* is provided for striking the golf ball. In a preferred embodiment, the buffer recess 223*a* has a configuration selected from circular, triangular, rectangular and polygonal shapes or other geometric shapes depending on the design choice. Preferably, the upraised protrusion structure of the second metal plate 22' constructed from the annular protruded ribs 222' is in a meshed or honeycombed shape that can reinforce the structural strength of the complex skirt plate 2*a*. Areas of the buffer recesses 223*a* of the complex skirt plate 2*a* may vary and reduce from a middle portion to a rear-side portion of the golf club head. Accordingly, the number of the annular protruded ribs 222' in a unit area of the rear-side portion is greater than that in the middle portion. This results in the center of gravity of the complex skirt plate 2*a* is adjusted and thus moved reward that enhances the striking stability of the golf club head. In an alternative embodiment, such a meshed or honeycombed shape of the complex skirt plate 2*a* can be changed to the sole, crown or striking plate depending on the design choice.

Figure 7:
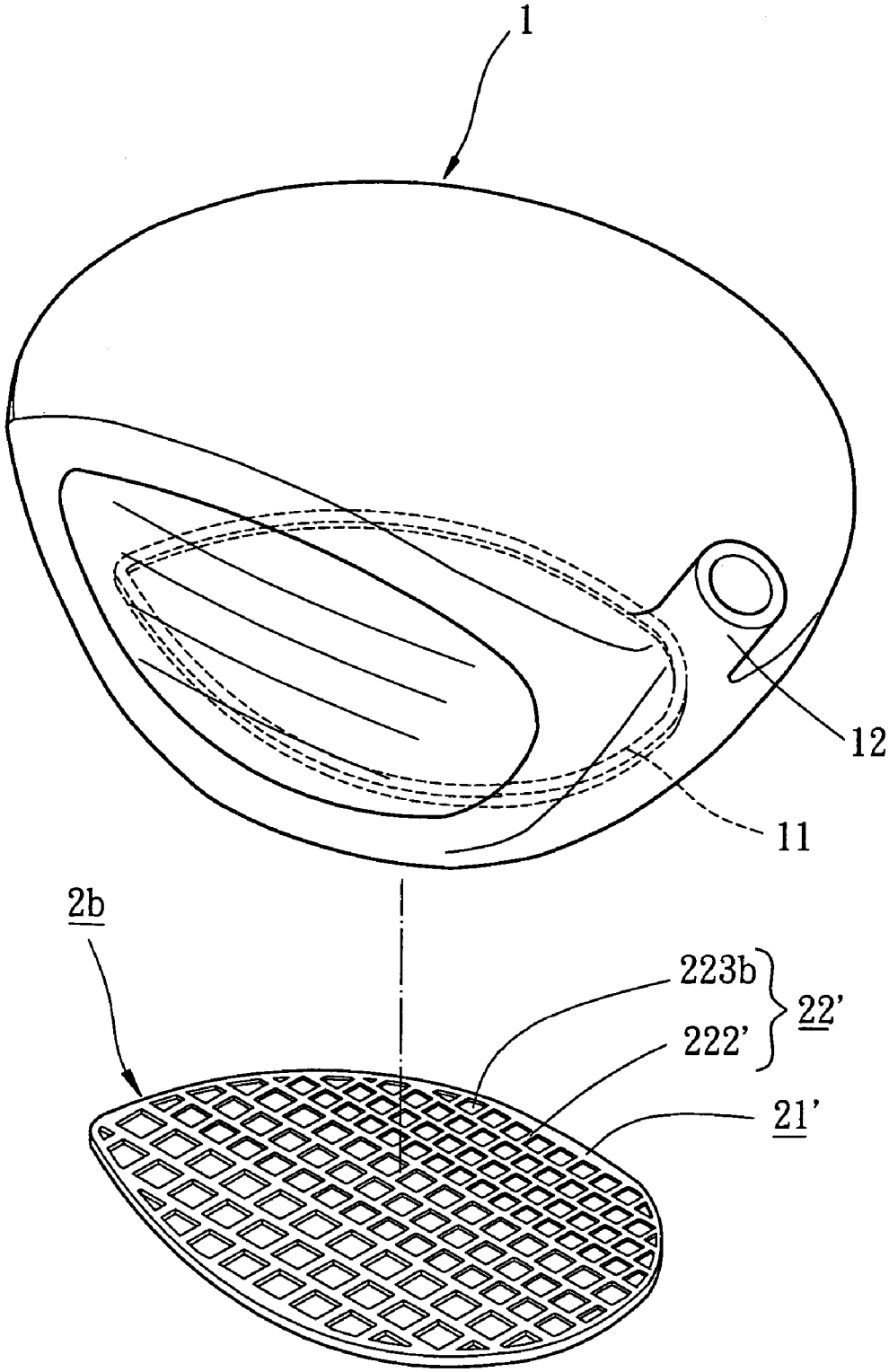
FIG. 7 is an exploded perspective view illustrating the wood-type golf club head body and the complex sole plate formed with the upraised protrusion structure in accordance with a fifth embodiment of the present invention.

Turning now to FIG. 7, an exploded perspective view of the wood-type golf club head body and the complex sole plate formed with the upraised protrusion structure in accordance with a fifth embodiment of the present invention is illustrated. In comparison with the fourth embodiment, the wood-type golf club head of the fifth embodiment includes a complex sole plate 2*b* formed by combing a first metal plate 21' with a second metal plate 22'. Formed among the annular protruded ribs 222' are buffer recess 223*b* where an adequate space for deformation of the complex sole plate 2*b* is provided for striking the golf ball. In the first embodiment, the buffer recess 223*b* is square in shape. Other shapes are circular, triangular, rectangular, polygonal shapes or other geometric shapes depending on the design choice. Preferably, the upraised protrusion structure of the second metal plate 22' constructed from the annular protruded ribs 222' is in a square meshed shape that can reinforce the structural strength of the complex sole plate 2*b*. Areas of the buffer recesses 223*b* of the complex sole plate 2*b* may vary and reduce from a front-side portion to a rear-side portion of the golf club head. Accordingly, the number of the annular protruded ribs 222' in a unit area of the rear-side portion is greater than that in the middle portion. This results in the center of gravity of the complex sole plate 2*b* is adjusted and thus moved reward that enhances the striking stability of the golf club head. In an alternative embodiment, such a square shape of the complex sole plate 2*b* can be changed to the crown, sidewall or striking plate depending on the design choice.

As has been discussed above, the conventional striking plate is integrally provided with the spiral-shaped or annular upraised protrusion that may however affect the vibration absorbability of the striking plate. Alternatively, another conventional striking plate is provided with a first metal plate only having a periphery formed with the second metal plate that may weaken the structural strength of the center portion. Conversely, the "hybrid" one-piece design of the complex plate of the present invention has the upraised protrusion structure such as a reinforcing protruded block or annular protruded ribs that provide the buffer grooves or recesses. The complex plate of the present invention can enhance the structural strength, vibration absorbability and the elastic deformability of the complex plate. Furthermore, the complex plate of the present invention has a first metal plate made from the high-degree elastically deformable material that may enhance the striking stability of the golf club head.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head, comprising:

a golf club head body including a blade portion, a sole portion, a heel-side portion, a toe-side portion and a hosel portion, the golf club head body having an assembling opening disposed at a front portion; and a complex striking plate including a base plate made from a first metal material and an upraised protrusion structure made from a second metal material different from the first metal material, the base plate having a front surface and a rear surface, said upraised protrusion structure being formed on the rear surface of the complex striking plate, the upraised protrusion structure including a reinforcing protruded block and a plurality of annular protruded ribs, a buffer structure formed in said upraised protrusion structure;

wherein the complex striking plate is mounted to the assembling opening of the golf club head body to constitute the golf club head.

2. The golf club head as defined in claim 1, wherein an explosion-welding layer, a rolled connection layer or an adhesive layer is formed between the base plate and the upraised protrusion structure.

3. The golf club head as defined in claim 1, wherein the golf club head body includes an engaging wall formed in the assembling opening, the complex striking plate includes an engaging outer circumference engaged with the engaging wall of the golf club head body.

4. The golf club head as defined in claim 1, wherein the first metal material of the base plate is selected from a high-degree elastically deformable metal material.

5. The golf club head as defined in claim 1, wherein the second metal material of the upraised protrusion structure is selected from a high-degree vibration absorbable metal material.

6. The golf club head as defined in claim 1, wherein the first metal material of the base plate has a specific gravity lower than that of the second metal material of the upraised protrusion structure.

7. The golf club head as defined in claim 1, wherein the buffer structure is constructed from a plurality of buffer grooves.

8. A golf club bead, comprising:

a golf club head body including a striking portion, a crown portion, a sole portion, a rear skirt portion, a heel-side skirt portion and a toe-side skirt portion which form a hollow body, the golf club head body made from a first metal material; and an upraised protrusion structure constructed from annular protruded ribs and made from a second metal material different from the first metal material, said upraised protrusion structure being formed on at least one of the striking portion, the crown portion, the sole portion, the rear skirt portion, the heel-side skirt portion and the toe-side skirt portion to form at least one complex plate;

a buffer structure formed in said upraised protrusion structure;

wherein a number of the annular protruded ribs in a unit area of a rear-side portion of the golf club head body is greater than tat in a middle portion when the upraised protrusion structure is selectively formed on an inner surface of one of the crown portion, the sole portion, the heel-side skirt portion and the toe-side skirt portion.

9. The golf club head as defined in claim 8, wherein an explosion-welding layer, a rolled connection layer or an adhesive layer is formed between the base plate and the upraised protrusion structure.

10. The golf club head as defined in claim 8, wherein said upraised protrusion structure proximate a sole portion has a vertical height greater than that of said upraised protrusion structure proximate a crown portion when the upraised protrusion structure is formed on an inner surface of the striking portion.

11. The golf club head as defined in claim 8, wherein the buffer structure has a buffer groove formed between any two of the adjacent annular protruded ribs.

12. The golf club head as defined in claim 8, wherein the first metal material of the golf club head body has a specific gravity lower than that of the second metal material of the upraised protrusion structure.

13. A golf club head, comprising:

a golf club head body including a striking portion, a crown portion, a sole portion, a rear skirt portion, a heel-side skirt portion and a toe-side skirt portion which form a hollow body, the golf club head body made from a first metal material; and an upraised protrusion structure made from a second metal material different from the first metal material, said upraised protrusion structure constructed from a mesh-shaped protrusion and being formed on at least one of the striking portion, the crown portion, the sole portion, the rear skirt portion, the heel-side skirt portion and the toe-side skirt portion to form at least one complex plate;

a buffer structure formed in said upraised protrusion structure;

wherein the buffer structure includes a plurality of buffer recesses formed in the mesh-shaped protrusion.

14. The golf club head as defined in claim 13, wherein areas of the buffer recesses vary and reduce from a front-side portion to a rear-side portion of the golf club head.

15. The golf club bead as defined in claim 13, wherein an explosion-welding layer, a rolled connection layer or an adhesive layer is formed between the base plate and the upraised protrusion structure.

16. The golf club head as defined in claim 13, wherein said upraised protrusion structure proximate a sole portion has a vertical height greater than that of said upraised protrusion structure proximate a crown portion when the upraised protrusion structure is formed on an inner surface of the striking portion.

17. The golf club bead as defined in claim 13, wherein the first metal material of the golf club head body has a specific gravity lower than that of the second metal material of the upraised protrusion structure.

* * * * *